US010947075B2

(12) United States Patent
Fukuda

(10) Patent No.: US 10,947,075 B2
(45) Date of Patent: Mar. 16, 2021

(54) CONTROL APPARATUS AND CONTROL METHOD FOR CONTROLLING AN IMAGE FORMING SYSTEM, AND STORAGE MEDIUM

(71) Applicant: CANON KABUSHIKI KAISHA, Tokyo (JP)

(72) Inventor: Shin Fukuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/982,760

(22) Filed: May 17, 2018

(65) Prior Publication Data

US 2018/0334350 A1 Nov. 22, 2018

(30) Foreign Application Priority Data

May 22, 2017 (JP) ..... JP2017-101133
Jan. 26, 2018 (JP) ..... JP2018-011270

(51) Int. Cl.
*B65H 31/22* (2006.01)
*B65H 43/06* (2006.01)
(Continued)

(52) U.S. Cl.
CPC ..... *B65H 31/22* (2013.01); *B65H 31/10* (2013.01); *B65H 43/06* (2013.01);
(Continued)

(58) Field of Classification Search
None
See application file for complete search history.

(56) References Cited

U.S. PATENT DOCUMENTS 8,055,183 B2 11/2011 Inenaga
8,177,222 B2 5/2012 Yaginuma
(Continued)

FOREIGN PATENT DOCUMENTS

CN 101135959 A 3/2008
CN 101867719 A 10/2010
(Continued)

*Primary Examiner* — Fan Zhang
(74) *Attorney, Agent, or Firm* — Canon U.S.A., Inc. I.P. Division

(57) ABSTRACT

A control apparatus to control a system including an image forming apparatus and a sheet discharge apparatus. The control apparatus receives configuration information of the system, and discharge state information having a discharge destination and a stacking amount of sheets discharged by the sheet discharge apparatus, and job identification information of an image forming job of sheets to be picked up. The control apparatus generates a system configuration image based on the configuration information, generates a sheet bundle image based on the discharge state information, combines the sheet bundle image with the system configuration image based on the discharge destination, and displays them as combined. The sheet bundle image is displayed with a size corresponding to the stacking amount and a first sheet bundle image, which corresponds to the job identification information, and a second sheet bundle image, which does not correspond to the job identification information, are distinguishably displayed.

5 Claims, 15 Drawing Sheets

(51) Int. Cl.
*B65H 31/10* (2006.01)
*G03G 15/00* (2006.01)

(52) U.S. Cl.
CPC ..... *G03G 15/5091* (2013.01); *G03G 15/6529* (2013.01); *G03G 15/6538* (2013.01); *B65H 2220/02* (2013.01); *G03G 15/502* (2013.01); *G03G 2215/00556* (2013.01)

(56) References Cited

U.S. PATENT DOCUMENTS

| | | | | |
|---|---|---|---|---|
| 9,242,829 | B2 | 1/2016 | Miyajima | |
| 2001/0054793 | A1 | 12/2001 | Nakahira | |
| 2001/0054799 | A1 | 12/2001 | McComb | |
| 2005/0017426 | A1 | 1/2005 | Hirata | |
| 2006/0082818 | A1 | 4/2006 | Kasamatsu | |
| 2006/0261543 | A1 | 11/2006 | Miyake | |
| 2006/0285869 | A1 | 12/2006 | Kushida | |
| 2008/0055637 | A1 | 3/2008 | Hatakeyama | |
| 2008/0178120 | A1 | 7/2008 | Yamamoto | |
| 2008/0246989 | A1* | 10/2008 | Konuma | G03G 15/5016 358/1.15 |
| 2009/0041482 | A1* | 2/2009 | Inenaga | G03G 15/6547 399/23 |
| 2010/0251170 | A1 | 9/2010 | Louch | |
| 2011/0075195 | A1 | 3/2011 | Cain | |
| 2011/0157642 | A1 | 6/2011 | Nemoto | |
| 2011/0211888 | A1* | 9/2011 | Fujinaga | B41J 13/0009 399/403 |
| 2013/0334771 | A1 | 12/2013 | Igarashi | |
| 2014/0293329 | A1* | 10/2014 | Shimizu | G06F 3/1259 358/1.15 |
| 2015/0098101 | A1* | 4/2015 | Asakawa | G06K 15/404 358/1.13 |
| 2016/0031669 | A1 | 2/2016 | Mori | |
| 2016/0052320 | A1* | 2/2016 | Mutsuno | B41L 21/02 270/58.02 |
| 2016/0162222 | A1 | 6/2016 | De Boer | |
| 2018/0334350 | A1 | 11/2018 | Fukuda | |

FOREIGN PATENT DOCUMENTS

| | | | |
|---|---|---|---|
| CN | 101873430 | A | 10/2010 |
| CN | 102166896 | A | 8/2011 |
| CN | 102189775 | A | 9/2011 |
| CN | 102207950 | A | 10/2011 |
| CN | 102365635 | A | 2/2012 |
| CN | 103508245 | A | 1/2014 |
| CN | 103863876 | A | 6/2014 |
| CN | 104555541 | A | 4/2015 |
| CN | 106183484 | A | 12/2016 |
| JP | 2002362821 | A | 12/2002 |
| JP | 2009137186 | A | 6/2009 |
| JP | 2012093601 | A * | 5/2012 |
| JP | 2013146898 | A | 8/2013 |
| JP | 2014098875 | A | 5/2014 |

* cited by examiner

132

501

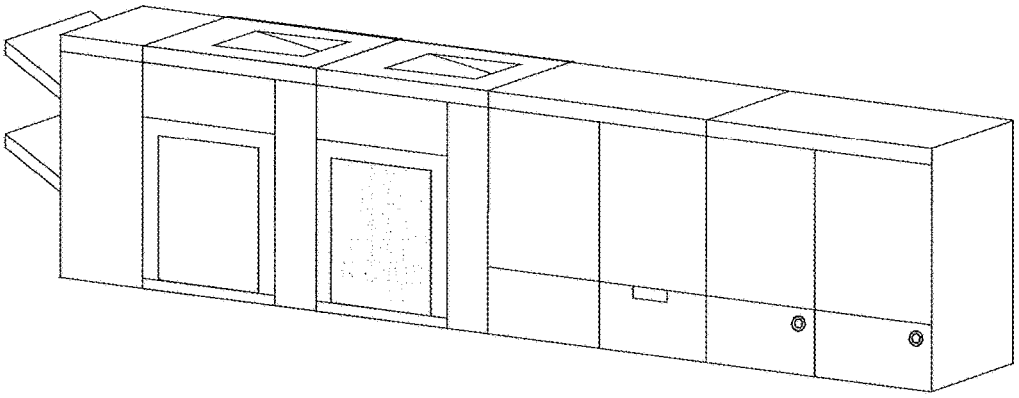

521 522 523

| STACKING TRAY | SHEET DISCHARGE APPARATUS | TRAY TYPE | TRAY POSITION COORDINATES |
|---|---|---|---|
| TRAY INFORMATION #1 | LARGE-CAPACITY STACKER (320) | TOP TRAY | (396, 102) |
| TRAY INFORMATION #2 | LARGE-CAPACITY STACKER (320) | LIFT TRAY | (376, 177) |
| TRAY INFORMATION #3 | LARGE-CAPACITY STACKER (320) | EJECTION TRAY | (347, 277) |
| TRAY INFORMATION #4 | LARGE-CAPACITY STACKER (340) | TOP TRAY | (257, 85) |
| TRAY INFORMATION #5 | LARGE-CAPACITY STACKER (340) | LIFT TRAY | (237, 160) |
| TRAY INFORMATION #6 | LARGE-CAPACITY STACKER (340) | EJECTION TRAY | (208, 260) |
| TRAY INFORMATION #7 | FINISHER (360) | UPPER TRAY | (92, 82) |
| TRAY INFORMATION #8 | FINISHER (360) | LOWER TRAY | (92, 155) |

FIG. 5

PROCESSED-JOB LIST

| JOB ID | JOB NAME | PROCESSING DAY/TIME | NUMBER OF PAGES | NUMBER OF BUNDLES | USED SHEET |
|---|---|---|---|---|---|
| 00000001 | IMAGE FORMING JOB #1 | 2011/08/13 13:52:21 JST | 5 | 100 | ABC PAPER C081 |
| 00000002 | IMAGE FORMING JOB #2 | 2011/08/13 14:09:02 JST | 20 | 5 | ABC PAPER C082 |
| 00000003 | IMAGE FORMING JOB #3 | 2011/08/21 09:11:43 JST | 20 | 30 | ABC PAPER C081 |
| 00000004 | IMAGE FORMING JOB #4 | 2011/08/22 10:34:28 JST | 60 | 500 | DEF PAPER/PLAIN PAPER |
| 00000005 | IMAGE FORMING JOB #5 | 2011/08/22 16:46:27 JST | 100 | 1 | XYZ PAPER/PLAIN PAPER |
| | | | | | |

FIG. 13A

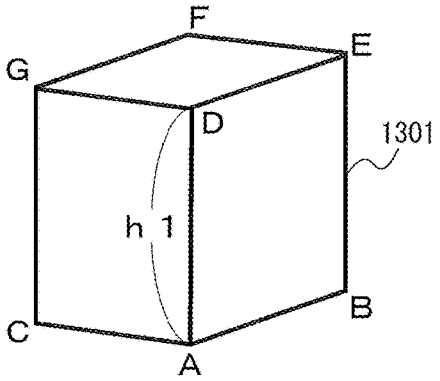

FIG. 13B

1302

| | COORDINATE POSITION |
|---|---|
| A | TRAY POSITION COORDINATES (x, y) |
| B | x+33 , y-13 |
| C | x-35 , y-5 |
| D | x, y-h1 |
| E | x+33 , y-h1-13 |
| F | x-5 , y-h1-17 |
| G | x-35 , y-h1-5 |

FIG. 13C

1303

```
<path stroke="black" stroke-width="1" fill="white" fill-opacity="0.7" d="M x (y-h1) L (x+33) (y-h1-13) L (x-5) (y-h1-17) L (x-35) (y-h1-5) Z"/>
<path stroke="black" stroke-width="1" fill="white" fill-opacity="0.7" d="M x (y-h1) L (x-35) (y-h1-5) L (x-35) (y-5) L x y Z"/>
<path stroke="black" stroke-width="1" fill="white" fill-opacity="0.7" d="M x (y-h1) L x y L (x+33) (y-13) L (x+33) (y-h1-13) Z"/>
```

FIG. 14A

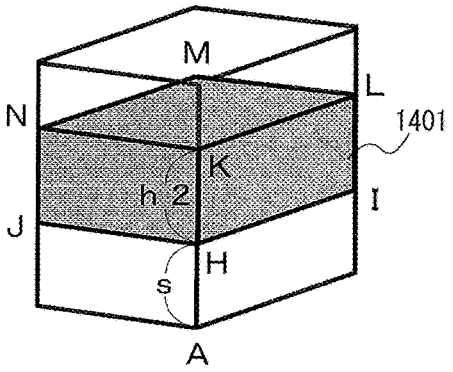

FIG. 14B

1402

| | COORDINATE POSITION |
|---|---|
| A | TRAY POSITION COORDINATES (x, y) |
| H | x , y-s |
| I | x+33 , y-s-13 |
| J | x-35 , y-s-5 |
| K | x, y-s-h2 |
| L | x+33 , y-s-h2-13 |
| M | x-5 , y-s-h2-17 |
| N | x-35 , y-s-h2-5 |

FIG. 14C

1403

```
<path stroke="black" stroke-width="1" fill="gray" fill-opacity="0.7" d="M x (y-s-h2) L (x+33) (y-s-h2-13) L (x-5) (y-s-h2-17) L (x-35) (y-s-h2-5) Z"/>
<path stroke="black" stroke-width="1" fill="gray" fill-opacity="0.7" d="M x (y-s-h2) L (x-35) (y-s-h2-5) L (x-35) (y-s-5) L x (y-s) Z"/>
<path stroke="black" stroke-width="1" fill="gray" fill-opacity="0.7" d="M x (y-s-h2) L x (y-s) L (x+33) (y-s-13) L (x+33) (y-s-h2-13) Z"/>
```

PROCESSED-JOB LIST

| JOB ID | JOB NAME | PROCESSING DAY/TIME | NUMBER OF PAGES | NUMBER OF BUNDLES | USED SHEET |
|---|---|---|---|---|---|
| 00000001 | IMAGE FORMING JOB #1 | 2011/08/13 13:52:21 JST | 5 | 100 | ABC PAPER C081 |
| 00000002 | IMAGE FORMING JOB #2 | 2011/08/13 14:09:02 JST | 20 | 5 | ABC PAPER C082 |
| 00000003 | IMAGE FORMING JOB #3 | 2011/08/21 09:11:43 JST | 20 | 30 | ABC PAPER C081 |
| 00000004 | IMAGE FORMING JOB #4 | 2011/08/22 10:34:28 JST | 60 | 500 | DEF PAPER/PLAIN PAPER |
| 00000005 | IMAGE FORMING JOB #5 | 2011/08/22 16:46:27 JST | 100 | 1 | XYZ PAPER/PLAIN PAPER |
| | | | | | |

CONTROL APPARATUS AND CONTROL METHOD FOR CONTROLLING AN IMAGE FORMING SYSTEM, AND STORAGE MEDIUM

BACKGROUND OF THE INVENTION

Field of the Invention

The present disclosure relates to a control apparatus, a control method for controlling an image forming system, and storage medium for controlling an image forming system including an image forming apparatus configured to form an image on a sheet and a plurality of sheet discharge apparatus configured to discharge the sheet having the image formed thereon.

Description of the Related Art

In recent years, a service form called production printing has been widely spread. In production printing, small-lot and high-variety printing orders are received from customers, and the orders are printed by an image forming apparatus at high speed to be delivered. At this time, images are rapidly formed onto a large amount of sheets, and the sheets are discharged to a large-capacity stacker. The large-capacity stacker stacks several thousands of sheets at one time. A plurality of large-capacity stackers may be connected so that, even when one large-capacity stacker is full, image formation can be continued by automatically switching a sheet discharge destination to another large-capacity stacker. In this case, sheets having images formed thereon and corresponding to the same image forming job are discharged to a plurality of sheet discharge destinations in a divided manner.

Meanwhile, an operator collects the discharged sheets having images formed thereon to perform the next operation. However, it is not easy to identify a position of a sheet corresponding to a predetermined image forming job from a large amount of sheets discharged to a plurality of sheet discharge destinations.

In order to address this issue, in Japanese Patent Application Laid-open No. 2013-146898, in order to allow an operator to check the sheet discharge destination for each image forming job, information on the large-capacity stacker corresponding to the discharge destination is displayed on a display device. In this manner, the operator can check the sheet discharge destination corresponding to each image forming job, and reliably collect the sheets corresponding to a processed job.

In the technology disclosed in Japanese Patent Application Laid-open No. 2013-146898, what is displayed on the display device is a state of the sheet discharge apparatus at a time point at which the selected image forming job is ended. Therefore, a sheet discharge state of the sheets before collection cannot be recognized as appropriate. Further, a discharge destination to which no sheets are actually discharged is not displayed. Therefore, in a case of the configuration in which a plurality of sheet discharge apparatus are connected, there remains an issue in that it is impossible to immediately recognize which sheet discharge apparatus the displayed sheet discharge destination corresponds to or what kind of state the stacked sheets are currently in. When the stacking states at the plurality of discharge destinations are recognizable, it becomes easy to determine which sheet discharge destination of the sheets is required to be selected in the subsequent image forming jobs to achieve efficiency, and the convenience is enhanced.

SUMMARY OF THE INVENTION

The present disclosure provides a system capable of easily recognizing a stacking state of sheets before collection, and a control apparatus for the system. In an example, an image region in which an entire arrangement configuration of an image forming apparatus and a sheet discharge apparatus is displayed and a list region in which processed jobs are listed are displayed on a monitor screen. In the image region, sheet bundle images corresponding to the processed jobs are mapped at corresponding positions of the sheet discharge tray. One sheet bundle image is an image of a sheet bundle corresponding to an image forming job designated in the list region, and is displayed in an emphasized manner with a color different from that of other sheet bundle images. In this manner, the position of the sheet bundle image corresponding to the designated processed job can be easily recognized.

According to an aspect of the present invention, a control apparatus to control a system including an image forming apparatus and a sheet discharge apparatus includes a processor, and a memory storing a program which, when executed by the processor, cause the control apparatus to: receive configuration information of the system, receive discharge state information for sheets discharged by the sheet discharge apparatus, wherein the discharge state information includes a discharge destination of the sheets and a stacking amount of the sheets, generate a system configuration image based on the configuration information, generate a sheet bundle image based on the discharge state information, combine the sheet bundle image with the system configuration image based on the discharge destination, display, on a display, a screen in which the system configuration image and the sheet bundle image are combined, wherein the sheet bundle image is displayed with a size corresponding to the stacking amount, and receive job identification information of an image forming job of sheets to be picked up, wherein, in the screen, a first sheet bundle image and a second sheet bundle image are distinguishably displayed, wherein the first sheet bundle image is a sheet bundle image which corresponds to the job identification information, and wherein the second sheet bundle image is a sheet bundle image which does not correspond to the job identification information.

Further features of the present disclosure will become apparent from the following description of embodiments (with reference to the attached drawings).

BRIEF DESCRIPTION OF THE DRAWINGS

FIG. 5 is a diagram of apparatus display information.

FIG. 13A is an illustration of a sheet bundle image, FIG. 13B is an illustration of a list, and FIG. 13C is an illustration of a rendering command using scalable vector graphics (SVG).

FIG. 14A is an illustration of a sheet bundle image, FIG. 14B is an illustration of a list, and FIG. 14C is an illustration of a rendering command using SVG.

DESCRIPTION OF THE EMBODIMENTS

First Embodiment

Figure 1:
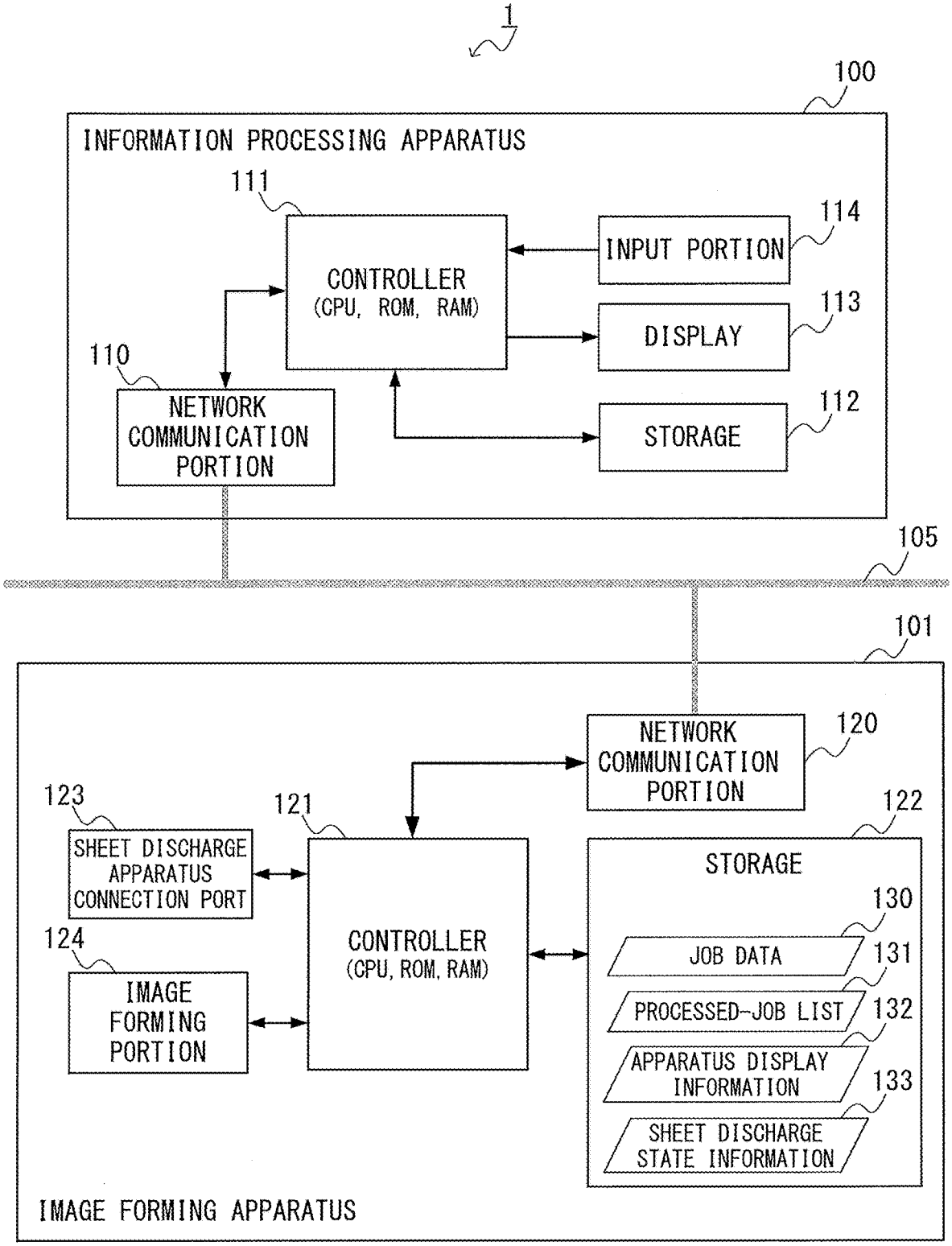
FIG. 1 is a configuration diagram of an image forming system.

FIG. 1 is a diagram for illustrating a schematic configuration example of an image forming system to which the present disclosure is applied. An image forming system 1 includes an information processing apparatus 100 and an image forming apparatus 101, which are connected to a communication network 105. The first embodiment represents an example in which one information processing apparatus 100 and one image forming apparatus 101 are provided, but a plurality of image forming apparatus 101 may be connected. The communication network 105 is a local area network (LAN). As the communication network 105, a wide area network (WAN), a combination of the LAN and the WAN, or a wired network may be employed instead.

The information processing apparatus 100 includes a network communication portion 110, a controller 111, a storage 112, a display 113, and an input portion 114. The network communication portion 110 controls the communication performed with the communication network 105. The storage 112 stores data in a short or long term. The display 113 performs various types of display for an operator. In the first embodiment, the display 113 displays, for example, a sheet bundle image and a system configuration image to be described later. The input portion 114 receives various instructions from the operator, a range designation, input data, and designation of a processed job. The processed job refers to an image forming job for which image formation to the sheet has been finished as described later. When the display 113 is constructed of a touch panel, various instructions from the operator also can be input from the display 113.

The controller 111 is one type of computer including a central processing unit (CPU), a read only memory (ROM), and a random access memory (RAM). The CPU executes a computer program for terminal control to execute various functions for the information processing apparatus 100. This operation is described later. The ROM stores the above-mentioned computer program and the like. The RAM is a work memory for the CPU.

The image forming apparatus 101 includes a network communication portion 120, a controller 121, a storage 122, a sheet discharge apparatus connection port 123, and an image forming portion 124. The network communication portion 120 controls the communication performed with the communication network 105. The storage 122 stores data in a short or long term. The sheet discharge apparatus connection port 123 connects the sheet discharge apparatus. The image forming portion 124 forms an image onto a sheet for each input image forming job. The controller 121 is a computer including a CPU, a ROM, and a RAM, or may be an embedded computer. The CPU executes a computer program for image formation control to form various functions for the image forming apparatus 101 and operate as a control apparatus for controlling an operation of each of the functions. This operation is described later. The ROM stores the above-mentioned computer program for image formation control. The RAM is a work memory for the CPU.

The storage 122 of the image forming apparatus 101 stores job data 130, a processed-job list 131, apparatus display information 132, and sheet discharge state information 133. Examples of the job data 130 include image data and instruction data representing the details of the input image forming job, data obtained after execution of the image forming job, and data obtained during the process of execution of the image forming job. The processed-job list 131 is a list storing the image forming jobs executed by the image forming apparatus 101 as the processed jobs. The processed-job list 131 stores job attributes such as identification information (job ID) for identifying the image forming job, a job name, the number of pages, the number of bundles, and a sheet in association with one another.

The apparatus display information 132 is one type of information representing the entire arrangement mode (system configuration) of image forming device and a plurality of sheet stacking device, and is referred to when a system configuration image to be described later is generated. In this example, information representing the outer appearance, structure, and size of each of the image forming apparatus 101 and the sheet discharge apparatus, and the outer appearance, structure, and size as a whole during connection is referred to as the apparatus display information 132. For example, the apparatus display information 132 represents a mode in which, when three sheet discharge apparatus are connected to the image forming apparatus 101 in a daisy-chain configuration, the sheet discharge apparatus adjacent to the image forming apparatus 101 is arranged as the first sheet discharge apparatus, and then the second sheet discharge apparatus and the third sheet discharge apparatus are sequentially arranged. The apparatus display information 132 is determined based on the combination and the arrangement order of the connected sheet discharge apparatus. The sheet discharge apparatus is arranged to be replaceable with other sheet discharge apparatus. Therefore, the apparatus display information 132 is updated to new information as appropriate.

The sheet discharge state information 133 is one type of information representing a sheet discharge state of sheets having images formed thereon in each sheet stacking device, and is referred to when a sheet bundle image to be described later is generated. Details are described later, but the sheet discharge state information at least includes sheet discharge destination information (tray information) related to a sheet discharge destination of the sheets, job identification information (job ID) for identifying the image forming job, and stacking amount information (sheet number count) related to a stacking amount of the discharged sheets. The sheet having an image formed thereon is hereinafter referred to as "sheet". Further, a bundle of a plurality of sheets is hereinafter referred to as "sheet bundle". The sheet discharge state information 133 includes information representing the shape and the size of the sheet or the sheet bundle, which is required for generating the sheet bundle image to be described later. This information is updated in real time every time a detection result of a stacking state detected by a detection device to be described later is received. The "sheet discharge state" herein refers to presence or absence of a sheet at a sheet stacking portion (including the change in portion at which the sheets are stacked), and the transition of the outer shape and the size of the sheet and the sheet stacking height, that is, refers to all the changes in sheet state until the sheets are collected by an ejecting operation to be described later.

Next, the sheet discharge apparatus to be connected to the sheet discharge apparatus connection port 123 of the image forming apparatus 101 are described. The sheet discharge apparatus refers to a large-capacity stacker and a finisher, and are apparatus capable of being combined or replaced afterwards. Those sheet discharge apparatus operate as sheet stacking device capable of stacking and collecting the sheets for each image forming job. That is, each sheet discharge apparatus stacks sheets corresponding to a processed job onto the sheet stacking portion to achieve a sheet bundle of each image forming job.

Figure 2:
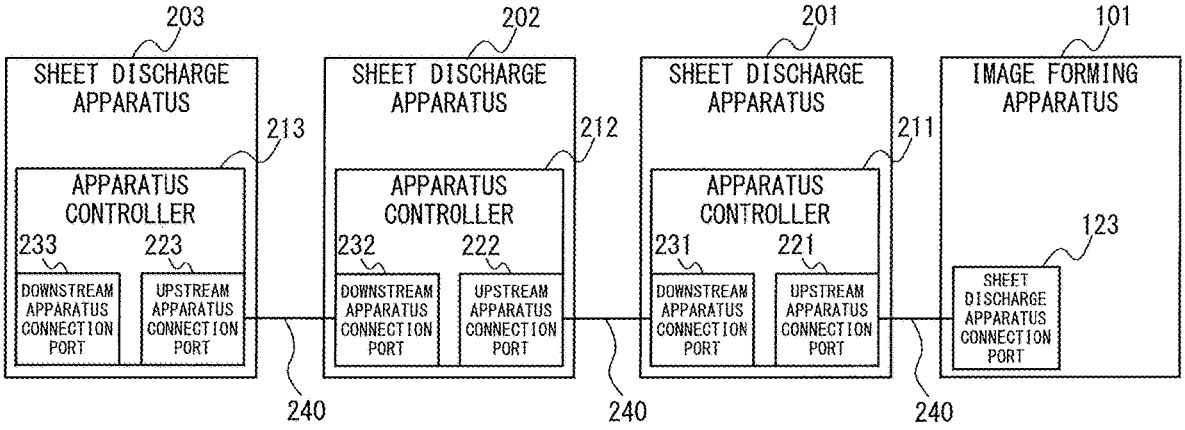
FIG. 2 is a schematic diagram for illustrating a state in which sheet discharge apparatus are connected to an image forming apparatus.

FIG. 2 is a schematic diagram for illustrating a connection example in a case in which three sheet discharge apparatus 201 to 203 are connected to the sheet discharge apparatus connection port 123 in a daisy-chain configuration. The sheet discharge apparatus 201 to 203 include apparatus controllers 211, 212, and 213, respectively, for controlling the operation of each own apparatus. The apparatus controllers 211, 212, and 213 include upstream apparatus connection ports 221, 222, and 223 and downstream apparatus connection ports 231, 232, and 233, respectively. Each of the upstream apparatus connection ports 221, 222, and 223 is a port for connecting to an apparatus on the upstream of the own apparatus via a communication cable 240. Each of the downstream apparatus connection ports 231, 232, and 233 is a port for connecting to an apparatus on the downstream of the own apparatus via the communication cable 240. In this manner, the image forming apparatus 101 and the three sheets discharge apparatus 201, 202, and 203 can communicate with each other. The third sheet discharge apparatus 203 may be omitted, or another apparatus that can communicate with the image forming apparatus 101 may be connected on the downstream of the third sheet discharge apparatus 203.

Figure 3:
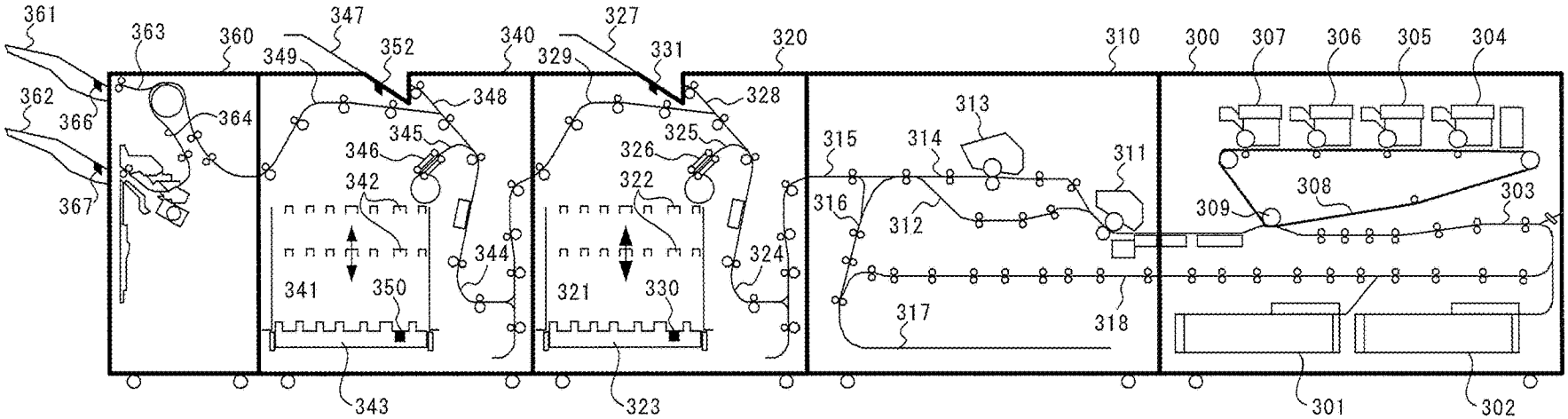
FIG. 3 is a sectional view for illustrating conveyance mechanisms of the image forming system.

Each of the image forming apparatus 101 and the sheet discharge apparatus 201, 202, and 203 includes a sheet conveyance mechanism as a mechanical element. FIG. 3 is an explanatory view for illustrating those conveyance mechanisms. In FIG. 3, an image forming unit 300 is a unit configured to form an image to be transferred onto a sheet, and corresponds to the image forming portion 124 in FIG. 1. An image fixing unit 310 is a unit configured to fix the transferred image. Two large-capacity stackers 320 and 340 and one finisher 360 are connected to the image fixing unit 310 in a daisy-chain configuration.

In the image forming unit 300, each of sheet feeding decks 301 and 302 separates one uppermost sheet among the received sheets to convey the sheet to a sheet conveyance path 303. Development stations 304 to 307 use toner having colors of yellow (Y), magenta (M), cyan (C), and black (K) to cause adhesion of toner images. The adhering toner images are primarily transferred onto an intermediate transfer belt 308. The intermediate transfer belt 308 rotates, for example, clockwise to convey the sheet to a secondary transfer position 309. At this time, the toner images are transferred onto the sheet conveyed through the sheet conveyance path 303. The sheet having the toner images transferred thereon is conveyed to the image fixing unit 310.

In the image fixing unit 310, a fixing unit 311 melts and pressurizes the toner images to fix the toner images onto the sheet. The sheet that has passed through the fixing unit 311 is conveyed from a sheet conveyance path 312 to a sheet conveyance path 315. Additional heating and pressurization may be required depending on the sheet type. In this case, after the sheet passes through the fixing unit 311, the sheet is conveyed to a second fixing unit 313 using a sheet conveyance path in the stage subsequent to the fixing unit 311. The sheet subjected to additional heating and pressurization is conveyed to a sheet conveyance path 314. A reversing portion 316 reverses the conveyed sheet by a switch-back method. When an image is formed on one side of the sheet, the reversed sheet, that is, the sheet having an image formed thereon, is conveyed to the sheet conveyance path 315. When images are formed on both sides of the sheet, the sheet is conveyed to a duplex reverse path 317, and is reversed to be conveyed to a duplex conveyance path 318. In this manner, an image is formed on the second side at the secondary transfer position 309, and the sheet is conveyed to the sheet conveyance path 315. The sheet that has passed through the sheet conveyance path 315 passes through a sheet conveyance path 324 to be input to the large-capacity stacker 320.

The large-capacity stacker 320 includes a stacking portion 321 including a lift tray 322 and an ejection tray 323, which are each configured to stack sheets. Those trays are controlled by the apparatus controller 211 illustrated in FIG. 2. The lift tray 322 is positioned at a sheet stacking portion having a predetermined height under a state in which no sheets are stacked, and is lowered when the stacking proceeds. The ejection tray 323 is a tray for re-stacking the sheets at a time point at which the lift tray 322 is lowered to a re-stacking position, to thereby eject the sheets to the outside of the apparatus. The lift tray 322 and the ejection tray 323 are formed so that their bars for supporting the sheets are present at alternate positions. Therefore, the sheets on the lift tray 322 can be re-stacked onto the ejection tray 323 without issue. The sheet passes through the sheet conveyance path 324 and a sheet conveyance path 325 to be conveyed to a sheet discharge unit 326. The sheet discharge unit 326 includes a lower rotary member and an upper rotary member that are configured to nip the sheet, and to discharge the sheet in a flipped manner to the lift tray 322. The action of "discharging the sheet in a flipped manner" refers to an action of discharging the sheet with the front and back sides being reversed so that one of both surfaces of the sheet on a side in contact with the lower rotary member of the sheet discharge unit 326 is turned to become an upper surface on the lift tray 322.

The lift tray 322 is controlled to be lowered by an amount of a height of the stacked sheets as the stacking of the sheets proceeds so that an upper end of the stacked sheets is at a predetermined height. When the lift tray 322 is in a fully-stacked state, the lift tray 322 is lowered to the position of the ejection tray 323. The "fully-stacked state" refers to a state in which the sheets reach a maximum stackable amount of the lift tray 322 and no more sheets can be stacked on the lift tray 322. Then, at a time point at which the lift tray 322 reaches the re-stacking position that is lower than the ejection tray 323, the sheets are re-stacked onto the ejection tray 323. After that, the ejection tray 323 is carried to the outside of the apparatus. In this manner, the sheets are removable. This operation is called "ejecting operation".

The large-capacity stacker 320 further includes a top tray 327. The top tray 327 is one sheet stacking portion mainly used for outputting a sample of the sheets to be stacked on the stacking portion 321. During discharge to the stacking portion 321, one sheet (or one bundle) is output to the top tray 327 as a sample. In this manner, the quality of the image formation can be checked without taking out the sheets stacked in the stacking portion 321. When a sheet is output to the top tray 327, the sheet passes through the sheet conveyance path 324 and a sheet conveyance path 328 to be conveyed to the top tray 327. When a sheet is conveyed to an apparatus on the downstream of the large-capacity stacker 320, the sheet is conveyed through a sheet conveyance path 329.

The ejection tray 323 and the top tray 327 include sheet presence/absence detection sensors 330 and 331, respectively. The sheet presence/absence detection sensors 330 and 331 operate as one type of detection device for detecting the change in stacking state of the sheets on the tray at every predetermined timing. The controller 121 receives the detection results of the sheet presence/absence detection sensors 330 and 331 in time series, and updates the sheet discharge state information 133 in the storage 122 based on the received detection results. In the first embodiment, description is given of an example in which the sheet presence/absence detection sensor detects the change in sheet stacking state, but the present disclosure is not limited thereto. For example, another sensor configured to detect the sheet stacking height may be provided, and the sensor may detect the change in sheet stacking state. Further, the CPU of the controller 121 may detect the change in sheet stacking state. The large-capacity stacker 340 has the same configuration as that of the large-capacity stacker 320. That is, the stacking portion 321 (lift tray 322 and ejection tray 323) of the large-capacity stacker 320 corresponds to a stacking portion 341 (lift tray 342 and ejection tray 343) of the large-capacity stacker 340. Similarly, the sheet conveyance paths 324, 325, 328, and 329 and the sheet discharge unit 326 of the large-capacity stacker 320 correspond to sheet conveyance paths 344, 345, 348, and 349 and a sheet discharge unit 346 of the large-capacity stacker 340, respectively. Further, the top tray 327 and the sheet presence/absence detection sensors 330 and 331 of the large-capacity stacker 320 correspond to a top tray 347 and sheet presence/absence detection sensors 350 and 352 of the large-capacity stacker 340, respectively. Those components are controlled by the apparatus controller 212.

The finisher 360 subjects the conveyed sheet to predetermined post-processing under the control of the apparatus controller 213 illustrated in FIG. 2 based on the function designated by the operator. As an example of the post-processing, in this example, the sheet is subjected to stapling (one-portion or two-portion binding) and punching (two or three holes). The finisher 360 includes two sheet discharge trays 361 and 362 each serving as a sheet stacking portion. To the sheet discharge tray 361, a sheet not to be subjected to post-processing, for example, stapling, is discharged through a sheet conveyance path 363. To the sheet discharge tray 362, a sheet subjected to a finishing function designated by the operator is discharged through a sheet conveyance path 364.

Each of the sheet discharge trays 361 and 362 is configured to be raised or lowered. It is also possible to perform such an operation that the sheet discharge tray 361 is lowered so that a plurality of sheets subjected to post-processing are stacked onto the sheet discharge tray 361. The sheet discharge trays 361 and 362 include sheet presence/absence detection sensors 366 and 367, respectively, which are each configured to detect the stacking state of the sheets on the tray. The sheet presence/absence detection sensors 366 and 367 also operate as one type of detection device for detecting the change in stacking state of sheets on the tray at every predetermined timing. The detection results are transmitted to the image forming apparatus 101 in time series by the apparatus controllers (see FIG. 2) included in the large-capacity stackers 320 and 340.

Next, description is given of the sheet stacking state in the large-capacity stacker 320 with reference to FIG. 4A to FIG. 4G. In each drawing, a right side as viewed from an observer corresponds to a sectional view in which the mechanical elements of the large-capacity stacker 320 are viewed from the front side, and a left side as viewed from the observer corresponds to a sectional view in which the mechanical elements of the large-capacity stacker 320 are viewed from the left lateral side. The large-capacity stacker 340 has a similar configuration, and hence the large-capacity stacker 320 is described as a representative stacker.

Figure 4A:
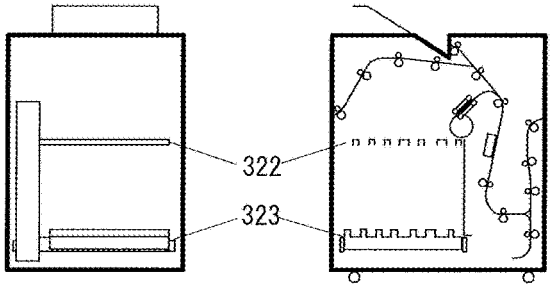
FIG. 4A, FIG. 4B, FIG. 4C, FIG. 4D, FIG. 4E, FIG. 4F, and FIG. 4G are schematic views for illustrating a process of an ejecting operation.

FIG. 4A is an illustration of a state in which no sheets are stacked on the large-capacity stacker 320. The lift tray 322 is raised and stopped at a predetermined height, that is, at a position of a sheet discharge port for discharging the sheets to the stacking portion 321. The ejection tray 323 is accommodated in the apparatus. FIG. 4B is an illustration of a state during an image forming operation. As the stacking of the sheet proceeds, the apparatus controller gradually lowers the lift tray 322 so that the height of the uppermost surface of the stacked sheets matches the position of the sheet discharge port of the stacking portion 321. FIG. 4C is an illustration of a state in which a fully-stacked state of the lift tray 322 is detected. When the lift tray 322 is in the fully-stacked state, stacking onto the lift tray 322 cannot be continued any more. Therefore, the apparatus controller starts control of re-stacking the stacked sheets onto the ejection tray 323. FIG. 4D is an illustration of a state in which the lift tray 322 is lowered to the re-stacking position of the ejection tray 323 and the sheets are re-stacked onto the ejection tray 323. Even when the lift tray 322 is lowered to the same height as that of the ejection tray 323, the bars for supporting the sheets are located at alternate positions, and hence the bars do not interfere with each other. At a time point at which the lift tray 322 reaches the re-stacking position that is lower than the ejection tray 323, there is obtained a state in which the sheets stacked on the lift tray 322 are re-stacked onto the ejection tray 323.

Figure 4E:
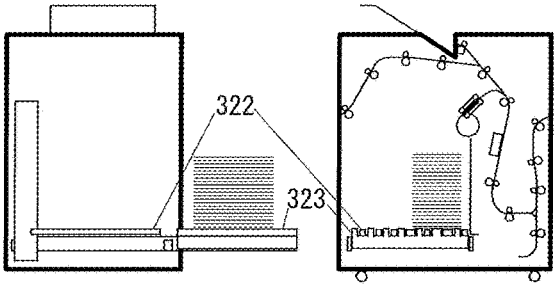
Figure 4B:
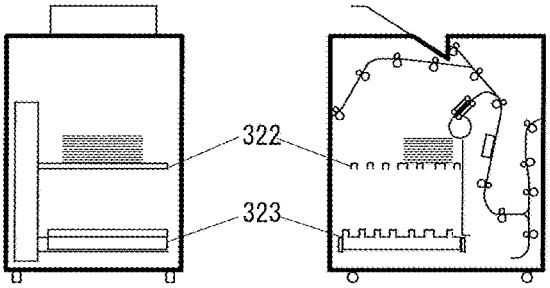
Figure 4F:
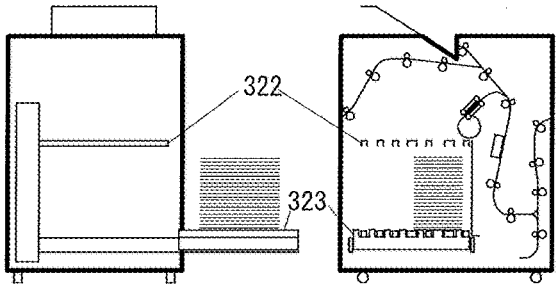
Figure 4C:
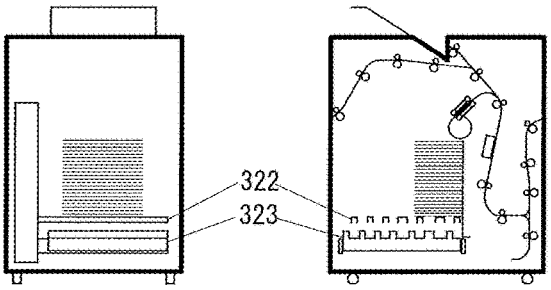
Figure 4G:
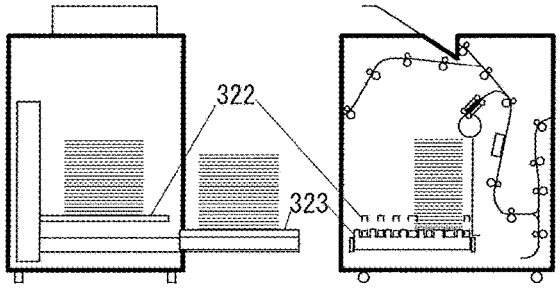
Figure 4D:
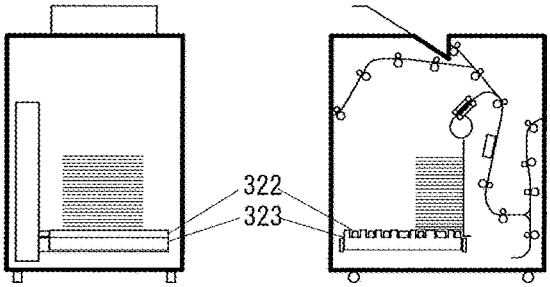

FIG. 4E is an illustration of a state in which the ejection tray 323 having the sheets stacked thereon is ejected to the outside of the apparatus. When the ejection tray 323 is ejected as described above, the stacked sheets become collectable. FIG. 4F is an illustration of a state in which, under a state in which the ejection tray 323 is ejected, the lift tray 322 is raised again to the position at which the subsequent sheets are stacked thereon. In this manner, sheets can be stacked on the lift tray 322. FIG. 4G is an illustration of a state in which, after the image formation is continued under a state in which the ejection tray 323 is ejected, the fully-stacked state of the lift tray 322 is detected. In this state, the ejection tray 323 is ejected, and hence the sheets stacked on the lift tray 322 cannot be re-stacked onto the ejection tray 323. The sheets stacked on the ejection tray 323 are required to be collected to continue the stacking in the large-capacity stacker 320.

FIG. 5 is a schematic diagram of the apparatus display information. Based on the apparatus display information 132 of FIG. 5 received from the image forming apparatus 101, display content to be described later is displayed on the display 113 of the information processing apparatus 100. The display content of a screen to be displayed on the display 113 is generated by the controller 11. Alternatively, the controller 121 of the image forming apparatus 101 may generate the display content and the information processing apparatus 100 may receive the display content. The content of the apparatus display information 132 differs depending on the combination of the sheet discharge apparatus. In the first embodiment, for the sake of convenience of description, it is assumed that the apparatus display information 132 corresponding to all combinations of mountable sheet discharge apparatus is stored in advance. As an example, description is given of an example of the apparatus display information 132 corresponding to the arrangement mode exemplified in FIG. 3. A schematic diagram is used in FIG. 5, but the actual apparatus display information 132 is stored in a form of an extensible markup language (XML) or comma-separated values (CSV), for example.

The upper stage of FIG. 5 represents a system configuration image 501 that visualizes the entire arrangement mode by expressing the entire arrangement mode in, for example, a bitmap format, and the lower stage of FIG. 5 represents a table in which information on position of the sheet discharge tray included in each sheet discharge apparatus is stored. The system configuration image 501 can be displayed as a two-dimensional image or a three-dimensional image, but is displayed as a three-dimensional image in this case. A sheet or a sheet bundle is not drawn in the system configuration image 501 illustrated at the upper stage of FIG. 5, but when a sheet is conveyed, a structure image of the sheet discharge tray at the stacking portion for the sheet is also displayed. For example, there is displayed a system configuration image including a structure image representing a lift tray and an ejection tray that are displaced in the above-mentioned large-capacity stackers 320 and 340. In the example illustrated in FIG. 3, each of the large-capacity stackers 320 and 340 includes three sheet discharge trays (top tray, lift tray, and ejection tray), and the finisher 360 includes two sheet discharge trays (upper tray and lower tray). Therefore, in such an arrangement mode, a total of eight sheet discharge trays are usable. In the system configuration image 501 at the upper stage of FIG. 5, an actual arrangement mode and structure images of those sheet discharge apparatus and sheet discharge trays are displayed. Therefore, the operator can intuitively recognize which sheet discharge tray the sheets are stacked on and whether the sheets are collectable.

In the table shown at the lower stage of FIG. 5, each of records of trays #1 to #8 corresponds to a sheet discharge apparatus 521 to which each tray is installed, a tray type 522, and tray position coordinates 523. That is, "tray #1" is the top tray of the large-capacity stacker 320, and is provided at tray position coordinates (396, 102) with reference to the system configuration image 501. The tray position coordinates are offset values (pixel numbers) in a right direction and a lower direction with the upper left of the system configuration image 501 serving as an origin. Other trays #2 to #8 have similar content.

Figure 6:
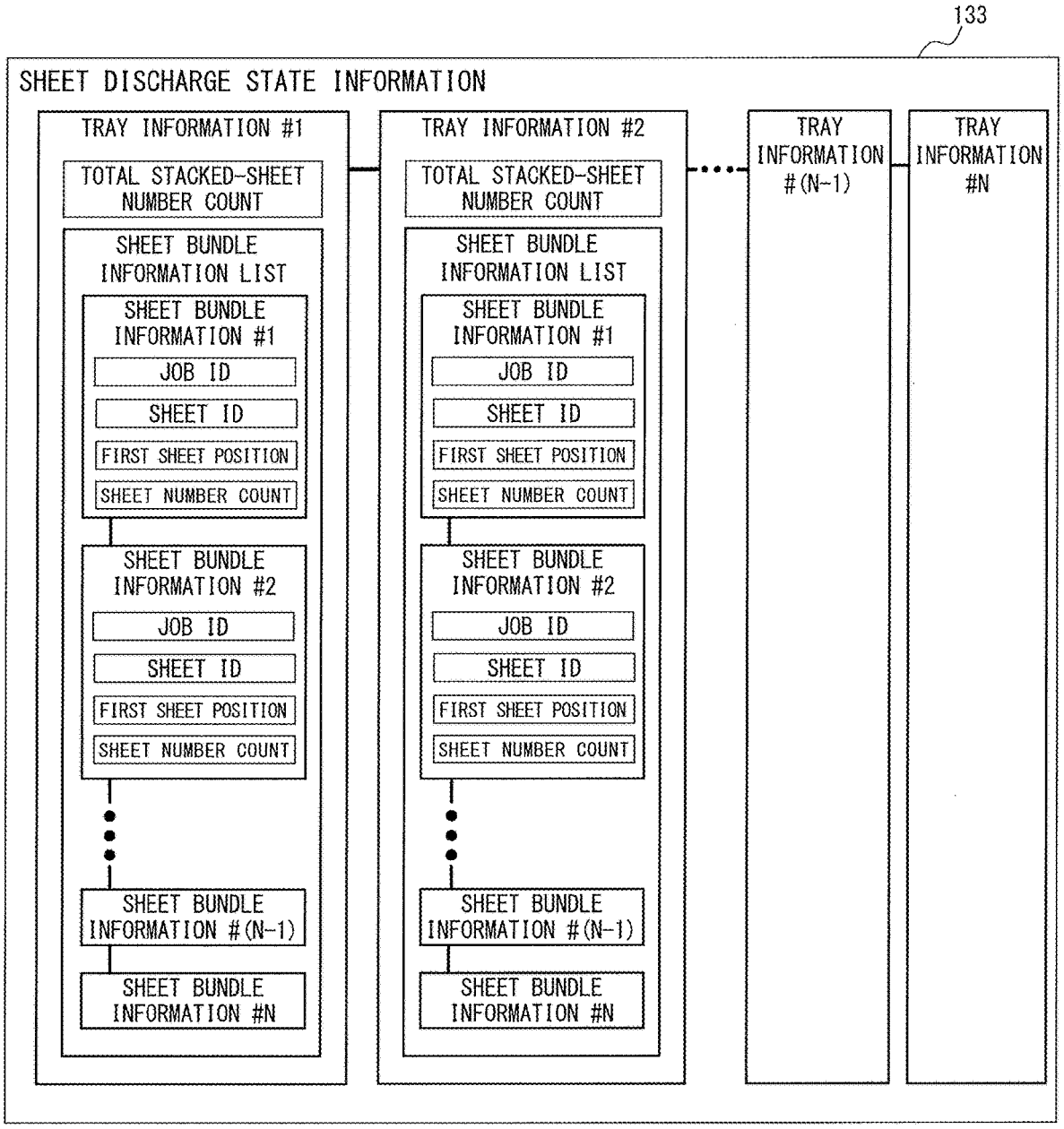
FIG. 6 is a diagram of sheet discharge state information.

FIG. 6 is a diagram of the sheet discharge state information 133. The sheet discharge state information 133 is stored in the storage 122 by the controller 121, and is updated at a timing at which the detection result of the stacking state in each sheet discharge tray is received, for example. Further, the sheet discharge state information 133 can be referred to by the controller 121 as appropriate. The sheet discharge state information 133 has a list-type data structure. That is, tray information (sheet discharge destination information) representing the stacking state of the usable sheet discharge tray for each tray is represented as tray information #1 to tray information #N. In the relationship with the table shown at the lower stage of FIG. 5, the detection result of the stacking state in the tray #1 corresponds to the tray information #1. The same applies to the tray information #2, the tray information #(N−1), and the tray information #N. N is a natural number, and N is 8 in the case of the arrangement mode illustrated in FIG. 3.

In FIG. 6, the tray information #1 to the tray information #8 are in a data format having a total stacked-sheet number count (stacking amount information) and a sheet bundle information list as member variables. The total stacked-sheet number count is a variable for counting a total number of sheets stacked on the sheet discharge tray. In the sheet bundle information list, pieces of sheet bundle information for managing the information on each sheet bundle are arranged in a list in the stacking order of the sheets. When no sheets are stacked on any sheet discharge tray, the sheet bundle information list is an empty list. Each piece of sheet bundle information has, as member variables, a job ID (job identification information), a sheet ID, a first sheet position, and a sheet number count. The job ID is a variable representing an ID of an image forming job corresponding to the sheet bundle. Each image forming job is allocated with a unique ID by the image forming apparatus 101, and the 1D is stored in the member variable. The sheet ID is a variable representing an ID of the sheet corresponding to the sheet bundle. The sheet is defined based on characteristics such as a size, a basis weight, and states of the front and back surfaces, and a sheet ID allocated for identifying the sheet is recorded in the member variable. The first sheet position is a variable representing what number the first sheet of the sheet bundle corresponds to when counted from the first sheet stacked on the sheet discharge tray. The sheet number count is a variable for counting the total number of sheets of the sheet bundle.

Figure 7:
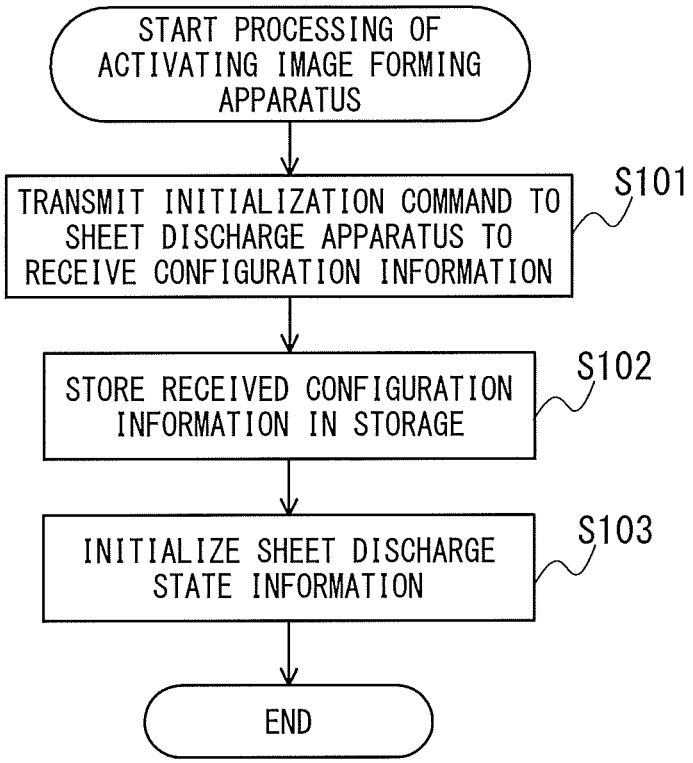
FIG. 7 is a flow chart for illustrating an operation procedure at the time when the image forming apparatus is activated.

Next, an operation of the image forming system 1 in the first embodiment is described. First, the operation of the image forming apparatus 101 at the time of activation thereof is described with reference to FIG. 7. FIG. 7 is a flow chart for illustrating the operation to be executed when the image forming apparatus 101 is activated. This flow chart is executed by the controller 121 controlling each portion in the image forming apparatus 101. When the image forming apparatus 101 is activated, the controller 121 transmits an initialization command to all of the connected sheet discharge apparatus via the communication cable, to thereby receive configuration information on each sheet discharge apparatus (Step S101). Each sheet discharge apparatus that has received the initialization command transmits back to the image forming apparatus 101 information including the sheet discharge apparatus ID for identifying the type of the own apparatus, the state information, and the apparatus configuration information (number of sheet discharge trays and positions of sheet discharge trays). The controller 121 can recognize the system configuration of the entire image forming system based on the information received in Step S101. In the example of the image forming system of FIG. 3, the controller 121 recognizes that two large-capacity stackers 320 and 340 are connected on the downstream of the image forming apparatus in the conveyance direction and the finisher 360 is connected on the further downstream. Then, the controller 121 recognizes that each of the large-capacity stackers 320 and 340 includes the top tray, the lift tray, and the ejection tray, and the finisher 360 includes two sheet discharge trays 361 and 362.

The controller 121 stores the system configuration information received from each sheet discharge apparatus in the storage 122 (Step S102). The system configuration information should include the sheet discharge apparatus ID. With the received configuration information, it can be recognized how the sheet discharge apparatus connected to the image forming apparatus 101 are currently arranged (order of the sheet discharge apparatus and the like), and as a result, where the sheet stacking portion is positioned. The controller 121 should identify the apparatus display information 132 corresponding to the arrangement mode of the currently-connected sheet discharge apparatus based on the stored sheet discharge apparatus ID from the apparatus display information 132 stored in advance in accordance with the combination of the sheet discharge apparatus. For example, in the arrangement mode illustrated in FIG. 3, the apparatus display information 132 corresponding to the configuration in which two large-capacity stackers and one finisher are connected is identified.

After the apparatus display information 132 is identified, the controller 121 initializes the sheet discharge state information 133 (Step S103). That is, the sheet discharge state information 133 is newly generated based on the system configuration information stored in Step S102. Sheets are not stacked yet on any sheet discharge tray immediately after the image forming apparatus 101 is activated. Therefore, in each piece of tray information of the sheet discharge state information 133, the total stacked-sheet number count is 0, and the sheet bundle information list is an empty list.

Figure 8:
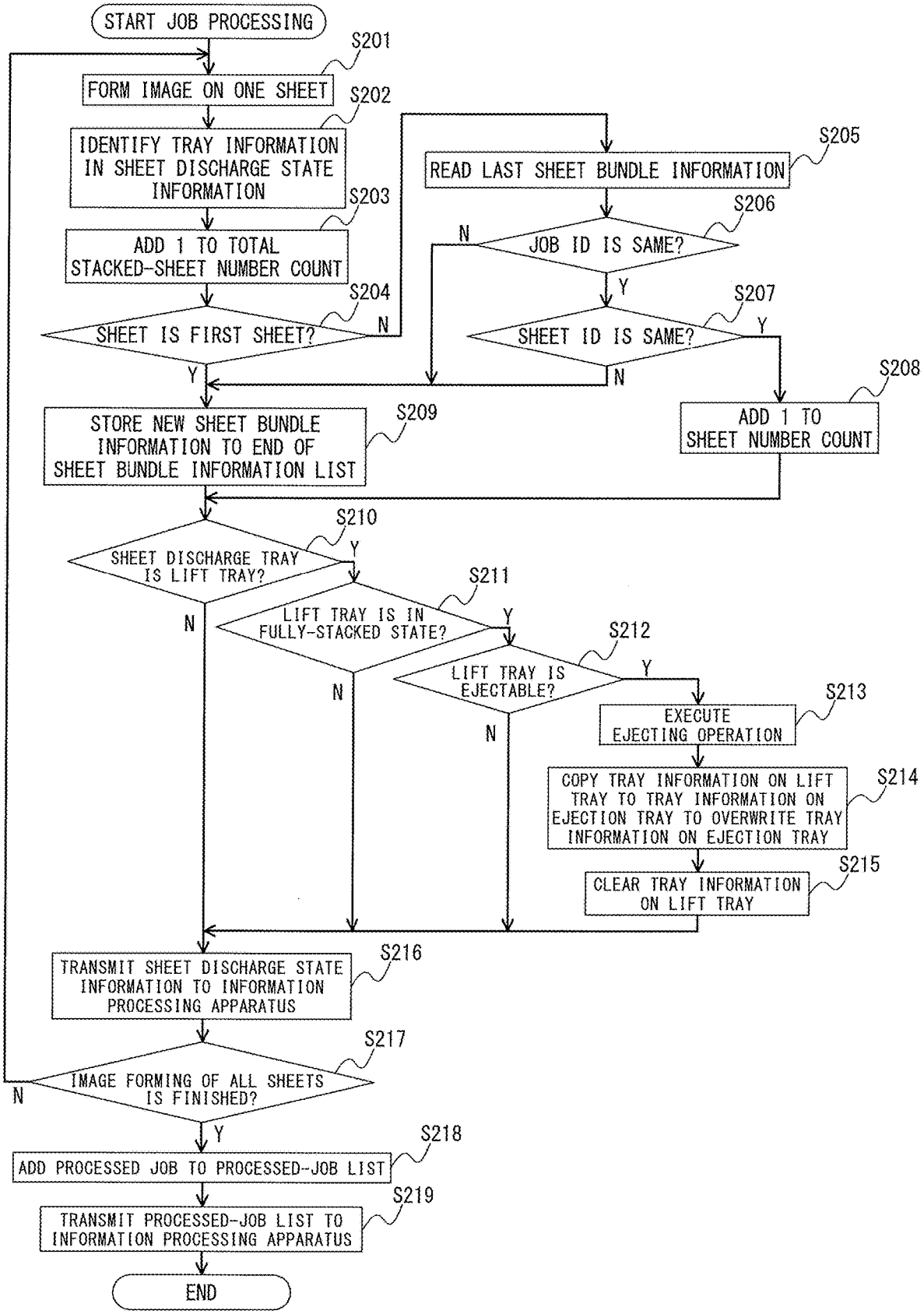
FIG. 8 is a flow chart for illustrating an operation procedure at the time when an image forming job is processed.

Next, with reference to FIG. 8, description is given of an operation example at the time when the image forming job is executed in the image forming apparatus 101. It is assumed that the image forming job is received from, for example, the information processing apparatus 100. The image forming job includes designation of tray information on the sheet stacking portion, that is, the sheet discharge apparatus to be used. In the following description, for the sake of convenience, it is assumed that the tray information on the large-capacity stacker 320 is designated. FIG. 8 is a control flow of the image forming apparatus 101 at this time. This control flow is also executed by the controller 121 integrally controlling the respective portions of the apparatus.

In the image forming apparatus 101, image formation of one sheet is performed in the order of pages in accordance with the image forming job. After the image formation, the conveyance of the sheet toward the large-capacity stacker 320 designated by the image forming job is started (Step S201). At this time, the controller 121 identifies the tray information on the designated large-capacity stacker 320 (Step S202). The tray information can be identified by referring to the apparatus display information 132 determined based on the arrangement mode of the sheet discharge apparatus. For example, tray #1 of the tray information of the table at the lower stage of FIG. 5 is referred to. Tray #1 corresponds to the top tray of the large-capacity stacker 320. Similarly, tray #2 corresponds to the lift tray of the large-capacity stacker 320. When tray #2 is identified here, the controller 121 refers to the record of tray #2 as the tray information.

The controller 121 adds 1 to the total stacked-sheet number count of the identified tray information (Step S203). The controller 121 further determines whether or not the discharged sheet is the first sheet in the sheet discharge tray based on the value of the total stacked-sheet number count (Step S204). When the sheet is not the first sheet (Step S204: N), the controller 121 refers to the tray information to read last sheet bundle information in the sheet bundle information list (Step S205). Then, the controller 121 determines whether or not the job ID of the job for which the image formation is performed is the same as the job ID in the sheet bundle information read in Step S205 (Step S206). When the job ID is the same (Step S206: Y), the controller 121 determines whether or not the sheet ID of the sheet subjected to image formation in Step S201 is the same as the sheet ID in the sheet bundle information read in Step S205 (Step S207). When the sheet ID is the same (Step S207: Y), the controller 121 adds 1 to the sheet number count of the last sheet bundle information in the tray information (Step S208), and the processing proceeds to Step S210.

When the sheet is the first sheet in Step S204 (Step S204: Y), when the job ID differs in Step S206 (Step S206: N), and when the sheet ID differs in Step S207 (Step S207: N), the controller 121 executes the processing of Step S209. That is, new sheet bundle information is generated at the end of the sheet bundle information list in the tray information. The member variables of the generated new sheet bundle information are as follows. First, the job ID is the job ID of the job for which the image formation is performed. The sheet ID is a sheet ID corresponding to the sheet subjected to image formation in Step S201. The total stacked-sheet number count is input as the first sheet position. Finally, the sheet number count is 1.

Next, the controller 121 determines whether or not the sheet discharge tray designated in Step S201 is the lift tray of the large-capacity stacker 320 (Step S210). When the sheet discharge tray is the lift tray (Step S210: Y), the controller 121 determines whether or not the lift tray is in the fully-stacked state after sheets are discharged in Step S201 (Step S211). When the lift tray is in the fully-stacked state (Step S211: Y), the controller 121 determines whether or not the lift tray in the fully-stacked state in Step S211 is ejectable (Step S212). Whether the lift tray is ejectable is determined based on whether or not the sheet bundles are stacked on the ejection tray of the same large-capacity stacker. When the sheet bundles are stacked on the ejection tray, that is, when the sheet presence/absence detection sensor 330 or the like detects that the sheet bundles are stacked, the controller 121 determines that the lift tray is not ejectable. Otherwise, the controller 121 determines that the lift tray is ejectable. When the lift tray is ejectable (Step S212: Y), the controller 121 re-stacks the sheet bundles stacked on the lift tray detected to be in the fully-stacked state in Step S211 onto the ejection tray, and executes the ejecting operation (Step S213). After that, the controller 121 copies, in the sheet discharge state information 133, the tray information on the lift tray for which the ejecting operation of the large-capacity stacker 320 is executed in Step S213, to the tray information on the same large-capacity stacker to overwrite the tray information on the same large-capacity stacker (Step S214). Further, the controller 121 clears, in the sheet discharge state information 133, the tray information on the lift tray for which the ejecting operation is executed in Step S213 (Step S215). In this case, clearing the tray information refers to obtaining an empty sheet bundle information list by setting the total stacked-sheet number count in the tray information to 0.

When the sheet discharge tray is not the lift tray (Step S210: N), when the lift tray is not in the fully-stacked state (Step S211: N), and when the lift tray is not ejectable (Step S212: N), the controller 121 transmits the sheet discharge state information 133 to the information processing apparatus 100 (Step S216). The same is applied after the tray information on the lift tray is cleared (Step S215). After that, the controller 121 determines whether or not the image formation of all of the sheets by the image forming job is finished (Step S217). When the image formation is not finished yet (Step S217: N), the processing returns to Step S201. When image formation of all of the sheets is finished (Step S217: Y), the controller 121 adds the processed job to the processed-job list 131 (Step S218). Then, the controller 121 transmits the processed-job list 131 that has been updated based on the addition to the information processing apparatus 100 (Step S219), and the series of processing is ended.

Figure 9:
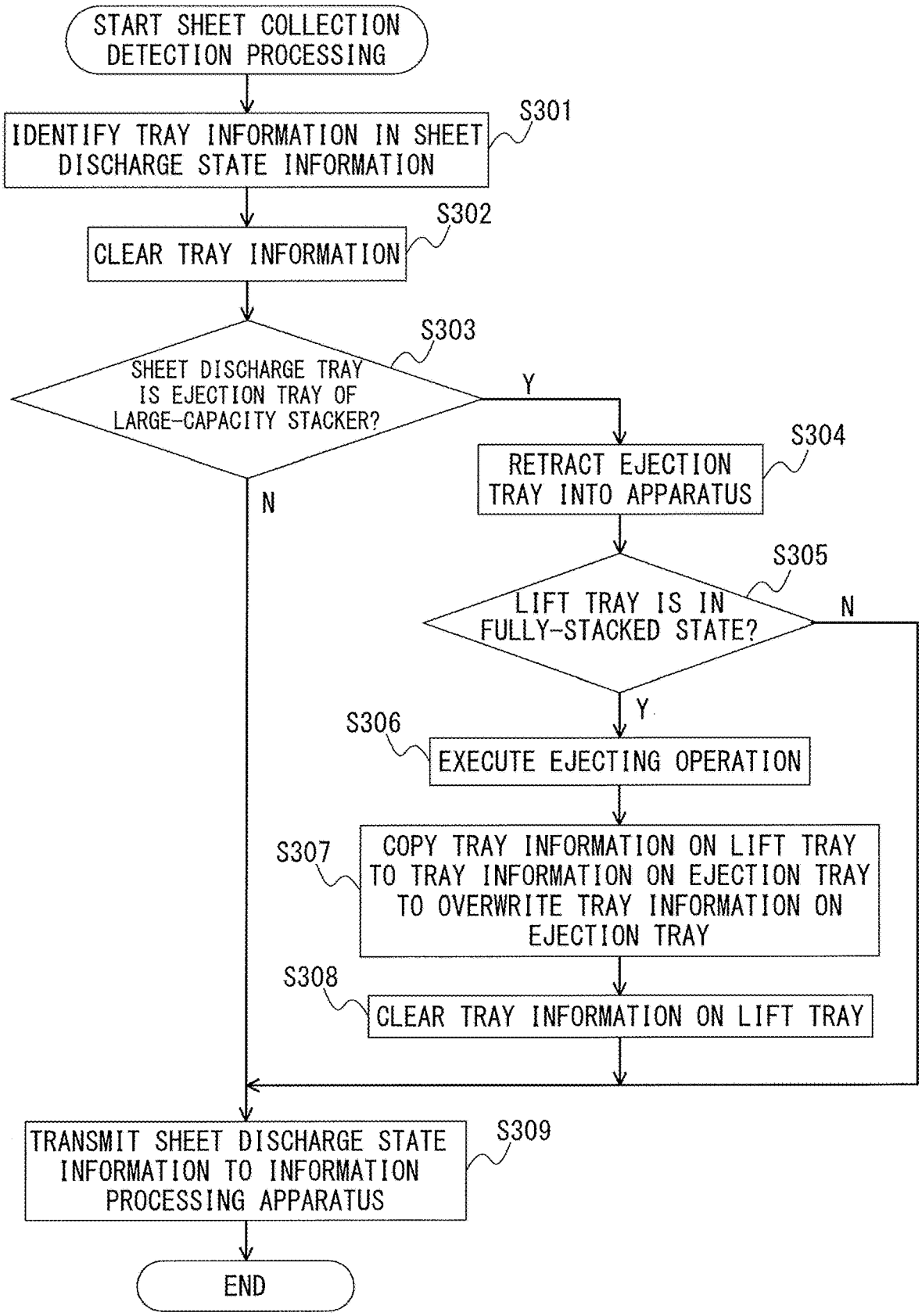
FIG. 9 is a flow chart at the time when sheets are removed from a sheet discharge tray.

Next, with reference to FIG. 9, description is given of an operation when the collection of sheets from the sheet discharge tray is detected in the image forming apparatus 101. FIG. 9 is a control flow of sheet collection detection processing. This control flow is also executed by the controller 121 integrally controlling the respective portions of the apparatus. The sheet collection is detected when a state in which the sheet presence/absence detection sensors 330 and 331 detect the stacking state of the sheet bundles is changed to a state in which the stacking state is not detected any more.

The controller 121 refers to the sheet discharge state information 133 to identify the tray information corresponding to the sheet discharge tray at which the sheet collection is detected (Step S301). Then, the controller 121 clears the tray information (Step S302). The controller 121 further determines whether or not the sheet discharge tray is the ejection tray 323 of the large-capacity stacker 320 (Step S303). When the sheet discharge tray is the ejection tray 323 (Step S303: Y), the controller 121 retracts the ejection tray 323 into the apparatus (large-capacity stacker 320) (Step S304). Further, the controller 121 determines whether or not the lift tray 322 of the large-capacity stacker 320 at which the sheet collection is detected is in the fully-stacked state (Step S305). When the lift tray 322 is in the fully-stacked state (Step S305: Y), the controller 121 re-stacks the sheets stacked on the lift tray 322 in the fully-stacked state onto the ejection tray 323 to execute the ejecting operation (Step S306). Then, the controller 121 copies, in the sheet discharge state information 133, the tray information on the lift tray 322 for which the ejecting operation is executed, to the tray information on the ejection tray 323 of the large-capacity stacker 320 to overwrite the tray information on the ejection tray 323 (Step S307). After that, the controller 121 clears, in the sheet discharge state information 133, the tray information on the lift tray 322 for which the ejecting operation is executed (Step S308).

When the sheet discharge tray corresponding to the empty tray information is not the ejection tray 323 (Step S303: N), the controller 121 transmits the sheet discharge state information 133 to the information processing apparatus 100 (Step S309), and ends the series of processing. The same processing is performed when the lift tray 322 is not in the fully-stacked state (Step S305: N) and after the tray information on the lift tray 322 is cleared in Step S308.

Figure 10:
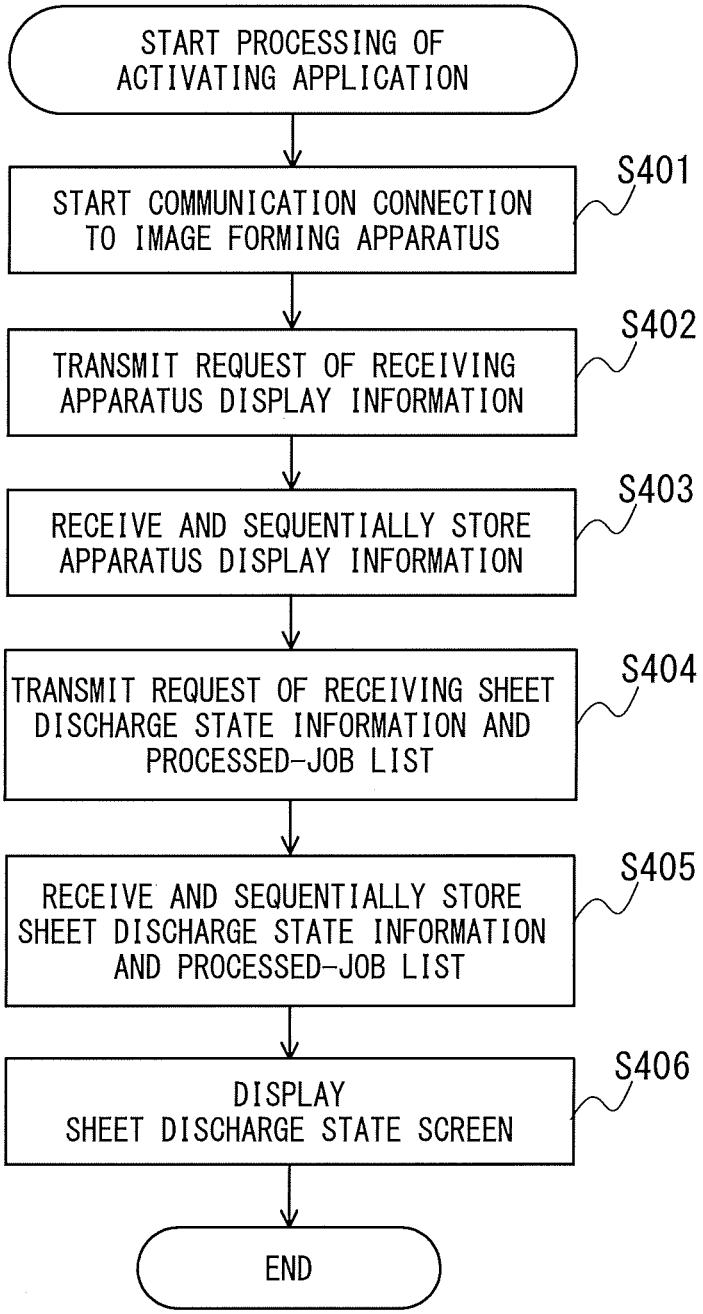
FIG. 10 is a control flow for illustrating an operation procedure of an information processing apparatus.

The operator can recognize the stacking state of each sheet discharge apparatus connected to the image forming apparatus 101 as required by an application executed by the computer program for terminal control in the information processing apparatus 100. The operation of the information processing apparatus 100 at this time is described with reference to FIG. 10. FIG. 10 is a control flow at the time when the application is activated. This control flow is executed by the controller 111 integrally controlling the respective portions of the terminal.

When an application is activated in the information processing apparatus 100, the controller 111 starts communication connection to the image forming apparatus 101 (Step S401). The communication connection refers to continuous establishment of a communication path until the operator inputs a clear cancel instruction. When the communication path is established, a request of receiving the apparatus display information 132 is transmitted to the image forming apparatus 101 (Step S402). When the image forming apparatus 101 receives this acquisition request, the image forming apparatus 101 transmits the apparatus display information 132 corresponding to the current apparatus configuration. When the apparatus display information 132 is updated while the communication connection is established, the image forming apparatus 101 transmits the updated apparatus display information 132 to the information processing apparatus 100. When the information processing apparatus 100 receives the updated apparatus display information 132 from the image forming apparatus 101, the information processing apparatus 100 sequentially stores the apparatus display information 132 to the storage 112 (Step S403).

The controller 111 further transmits a request of receiving the sheet discharge state information and the processed-job list to the image forming apparatus 101 (Step S404). When the image forming apparatus 101 (controller 121) receives this acquisition request, the image forming apparatus 101 (controller 121) transmits the sheet discharge state information 133 and the processed-job list 131 that are currently stored to the information processing apparatus 100. The controller 111 stores the sheet discharge state information 133 and the processed-job list 131 received from the image forming apparatus 101 to the storage 112 (Step S405). Further, the controller 111 generates a sheet discharge state screen based on the stored apparatus display information 132, sheet discharge state information 133, and processed-job list 131 to display the sheet discharge state screen on the display 113 (Step S406).

Figure 11:
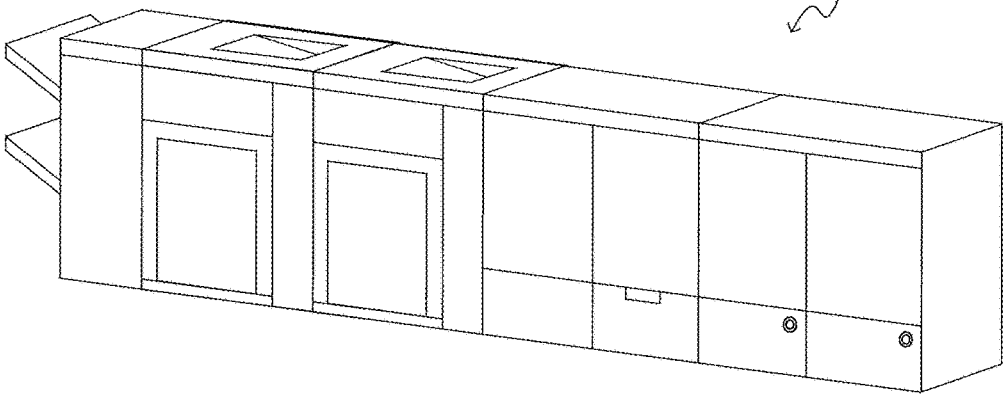
FIG. 11 is a display example of a monitor screen.

An example of a monitor screen is illustrated in FIG. 11. In a monitor screen 1100 exemplified in FIG. 11, an image region 1101 and a list region 1110 are formed. The image region 1101 is a region for visually displaying the system configuration image and the sheet stacking state of each image forming job, and has a two-display-layer structure. That is, the image region 1101 includes a first display layer for displaying the system configuration image, and a second display layer for displaying in combination a sheet bundle image at the sheet stacking portion of the system configuration image on the first display layer. In the first display layer, the system configuration image (system configuration image 501 illustrated in FIG. 5) generated based on the apparatus display information 132 stored in Step S403 is displayed. In the second display layer, based on the sheet discharge state information 133 received by the information processing apparatus 100, the sheet bundle image that visualizes the sheet or sheet-bundle stacking state in each sheet discharge tray is displayed in combination. The display of the sheet bundle image is updated in real time at a timing at which the change in sheet stacking state is detected. That is, the controller 111 is configured so that the mode of displaying the sheet bundle image on the display 113 can be changed in real time for each image forming job.

In FIG. 11, the system configuration image 1101 in a state in which no sheets are stacked on the sheet discharge tray is displayed. In the list region 1110, the processed-job list received by the information processing apparatus 100 from the image forming apparatus 101 is displayed. In the processed-job list, job attributes (job ID, job name, number of pages, number of bundles, and used sheet) of each processed job are displayed. The controller 111 allows the sheet bundle image to be displayed in the order in the processed-job list.

Further, the controller 111 allows the sheet bundle image corresponding to the designated processed job and the sheet bundle image corresponding to other processed jobs to be displayed in a distinguished manner.

The operator can operate the input portion 114 to designate any processed job on the processed-job list. In the example of FIG. 11, there is illustrated a state in which a processed job (job name: image forming job #3) having a job ID of "00000003" is designated. When the number of processed jobs listed in the processed-job list is larger than the number of jobs that can be displayed at one time in the list region 1110, a scroll bar 1111 is used. The operator can operate the scroll bar 1111 to designate any processed job. The designated processed job is displayed in a highlighted (inverted) manner to be distinguished from other processed jobs.

Figure 12:
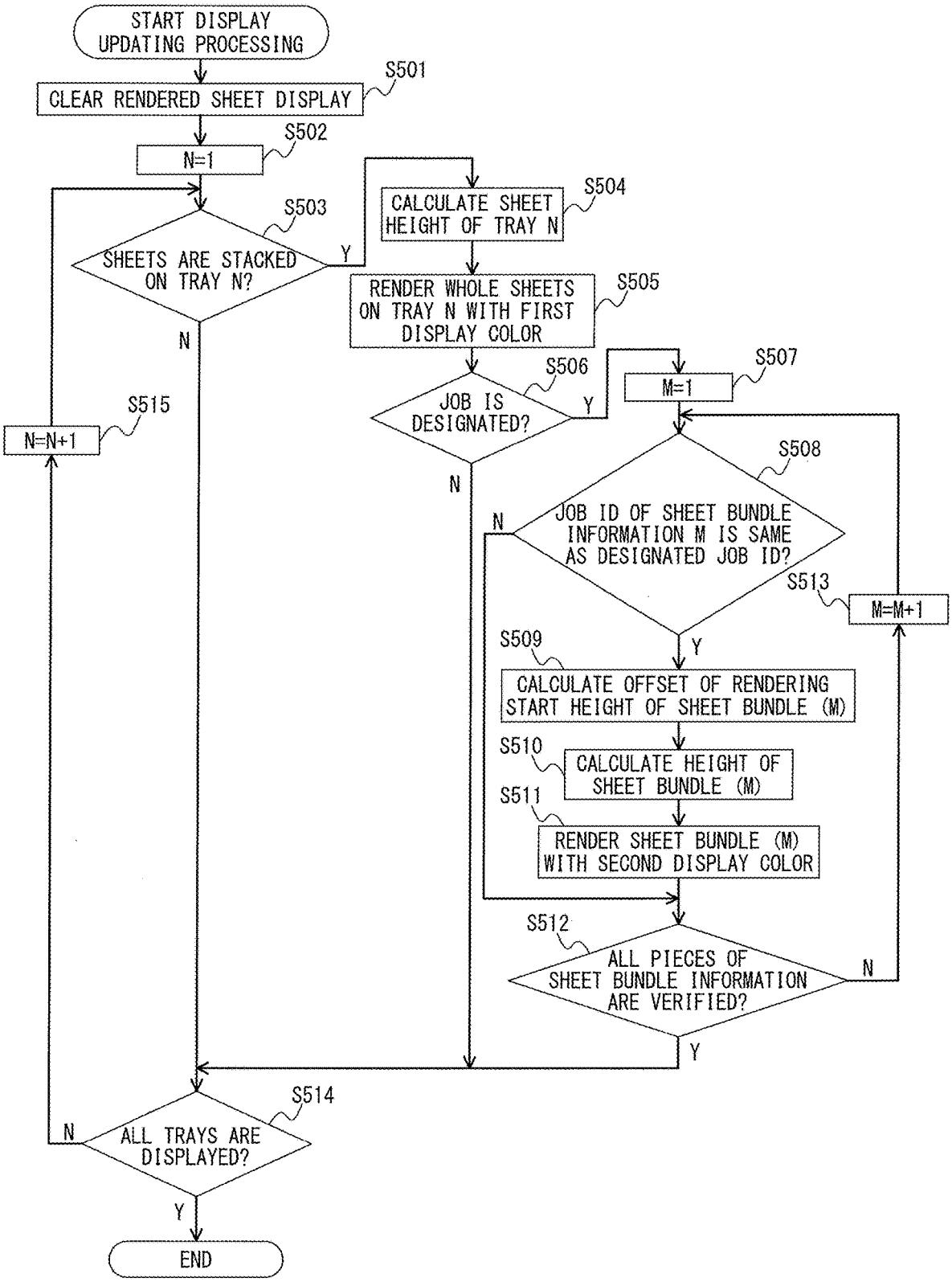
FIG. 12 is a flow chart for illustrating another operation procedure of the information processing apparatus.

Next, description is given of an operation example of a case in which the sheet discharge state information is received in the image forming apparatus 101, or a case in which the designated processed job is changed. FIG. 12 is a control flow to be executed by the controller 111 of the information processing apparatus 100 at this time. In FIG. 12, the controller 111 clears (deletes) the display of the sheet bundle image displayed in the second display layer of the image region 1101 (Step S501). The controller 111 substitutes 1 for a variable N representing the stacking order of the sheet discharge tray (Step S502), and then determines whether or not the sheets are stacked on the tray N in the sheet discharge state information (Step S503). When the total stacked-sheet number count in the tray information N is 0, it is determined that no sheets are stacked. When the sheets are stacked (Step S503: Y), the controller 111 calculates a height (h1 in FIG. 13) of the sheet bundle stacked on the tray N (Step S504). In this case, when the entire sheet bundle stacked on the tray N is displayed, the pixel of the height of the sheet bundle is calculated. The height of the sheet bundle is calculated by multiplying the total stacked-sheet number count of the tray information N by a predetermined coefficient P. The coefficient P is a coefficient representing the pixel corresponding to the height of one sheet. When the height of the sheet bundle includes a decimal value as a result of calculation, the value is rounded up to an integer value.

After the height of the sheet bundle is calculated, the controller 111 renders and displays the sheet bundle image representing the sheet bundle stacked on the tray N with a first display color (Step S505). As a result, a sheet discharge state screen in which the system configuration image and the sheet bundle image are combined is displayed on the display 113. After that, the controller 111 determines whether or not the image forming job is designated in the list region 1110 (Step S506). When no image forming job is designated (Step S506: N), the processing proceeds to Step S514. When the image forming job is designated (Step S506: Y), the controller 111 substitutes 1 for a variable M representing the order of the sheet bundle information (Step S507). The sheet bundle information M thereafter represents the M-th sheet bundle information in the sheet bundle information list of the tray information N of the received sheet discharge state information.

The controller 111 then determines whether or not the job ID of the sheet bundle information M is the same as the job ID of the image forming job designated in the list region 1110 (Step S508). When the job ID is not the same (Step S508: N), the processing proceeds to Step S512. When the job ID is the same (Step S508: Y), the controller 111 calculates a rendering start height offset (s in FIG. 14) of the sheet bundle (M) corresponding to the sheet bundle information M (that is, sheet bundle of designated image forming job) (Step S509). The rendering start position height of the sheet bundle (M) is calculated by multiplying the rendering start position of the sheet bundle (M) corresponding to the sheet bundle information M by the above-mentioned coefficient P. When the rendering start position height includes a decimal value as a result of the calculation, the value is rounded down to an integer value.

After that, the controller 111 calculates the height of the sheet bundle (M) corresponding to the sheet bundle information M (Step S510). That is, the controller 111 calculates the pixel corresponding to the height of the sheet bundle (M) when the sheet bundle image is displayed on the display 113. The height of the sheet bundle (M) is calculated by multiplying the sheet number count by the above-mentioned coefficient P. When the height of the sheet bundle includes a decimal value as a result of the calculation, the value is rounded up to an integer value.

After the height of the sheet bundle (M) is calculated, the controller 111 displays the sheet bundle image representing the sheet bundle (M) with a second display color (Step S511). In this manner, the sheet bundle image representing the sheet bundle (M) corresponding to the designated image forming job is displayed with the second display color. After the sheet bundle image is displayed with the second display color (Step S511), the controller 111 determines whether or not all pieces of sheet bundle information in the sheet bundle information list of the tray information N have been verified (Step S512). When all pieces of sheet bundle information have been verified (Step S512: Y), the processing proceeds to Step S514. When the verification of all pieces of sheet bundle information is not finished yet (Step S512: N), the controller 111 adds 1 to the variable M, and the processing returns to Step S508.

In Step S514, the controller 111 determines whether or not all pieces of tray information in the received sheet discharge state information have been displayed. When the display of all pieces of tray information is finished (Step S514: Y), the series of processing is ended. When the display of all pieces of tray information is not finished yet (Step S514: N), the controller 111 adds 1 to the variable N, and the processing returns to Step S503.

Now, a method of rendering the sheet bundle image to be displayed in Step S505 is described with reference to FIG. 13A to FIG. 13C. In this case, as an example, description is given of a method of rendering whole sheets on the ejection tray of the large-capacity stacker. A height (h1 of FIG. 13A) of a sheet bundle image 1301 is the height of the whole sheets calculated in Step S504. The sheet bundle image 1301 is rendered by seven points of vertex A to vertex G. In a list 1302 of FIG. 13B, which represents a method of calculating the coordinates of each vertex, the vertex A has tray position coordinates (coordinate values thereof are expressed as (x, y)) in the sheet discharge tray. The tray position coordinates of each sheet discharge tray are stored in the apparatus display information 132 stored in Step S403. The coordinate values of other vertices (B to G) are determined by adding or subtracting a predetermined offset value and the sheet height h1 to or from the coordinate values (x, y) of the vertex A.

The sheet bundle image 1301 is rendered by a rendering command of, for example, scalable vector graphics (SVG). In FIG. 13C, there is shown an example of a rendering command 1303 of the sheet bundle image 1301 at the time when the SVG is used. The shape of the sheet bundle image 1301 differs depending on the shape of the corresponding sheet discharge tray, but the point that the shape is determined based on the tray position coordinates, the predetermined offset value, and the sheet height is the same.

Next, a method of rendering the sheet bundle image to be displayed in Step S511 is described with reference to FIG. 14A to FIG. 14C. In this case, similarly to FIG. 13A to FIG. 13C, as an example, description is given of a method of rendering the sheet bundle image representing the image forming job designated in the ejection tray of the large-capacity stacker. A height (h2 of FIG. 14A) of a sheet bundle image 1401 to be displayed in Step S511 is the height of the sheet bundle calculated in Step S510. The sheet bundle image 1401 is rendered by seven points of vertex H to vertex N. In a list 1402 of FIG. 14B, which represents the method of calculating the coordinates of each vertex, the vertex A corresponds to tray position coordinates (coordinate values thereof are expressed as (x, y)) in the sheet discharge tray. The vertex H is determined based on the vertex A and the rendering start position height s of the sheet bundle calculated in Step S509. The coordinate values of other vertices (I to N) are determined by adding or subtracting a predetermined offset value and the sheet height h2 to or from the coordinate values of the vertex H. In FIG. 14C, there is shown an example of a rendering command 1403 of the sheet bundle image 1401 at the time when the SVG is used. The shape of the sheet bundle image 1401 differs depending on the shape of the corresponding sheet discharge tray, but the point that the shape is determined based on the tray position coordinates, the predetermined offset value, the position to start rendering of the sheet bundle, and the height of the sheet bundle is the same.

Figure 15:
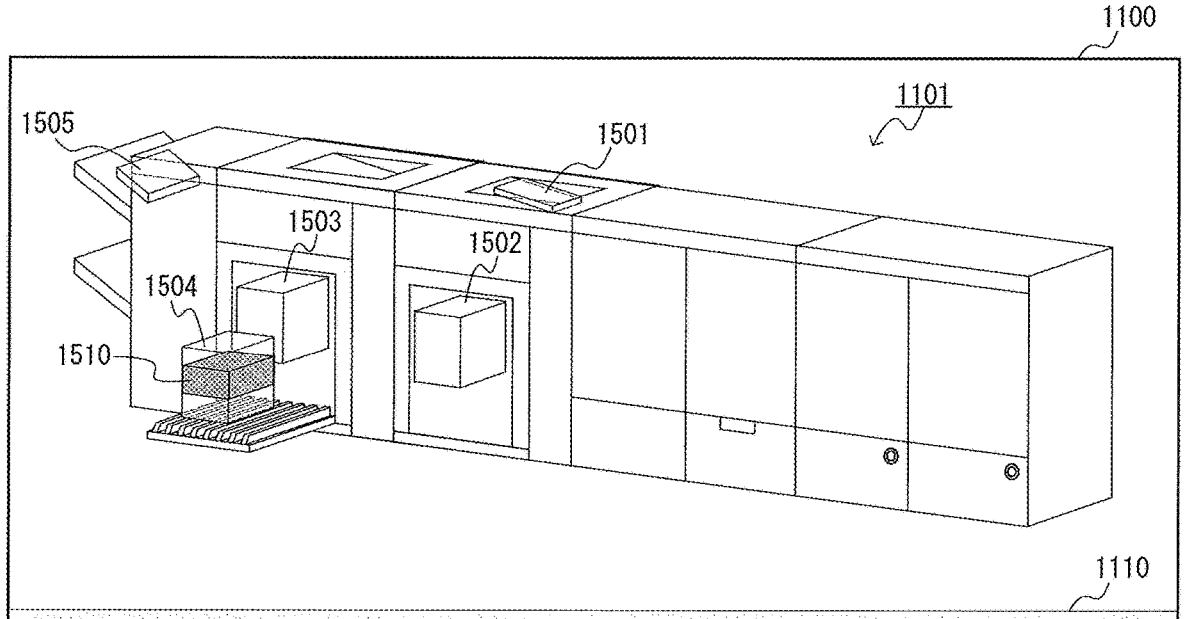
FIG. 15 is a display example of the monitor screen.

FIG. 15 is an example of a sheet discharge state screen to be displayed on the display 113 of the information processing apparatus 100. In FIG. 15, there are illustrated sheet bundle images 1501 to 1505, which are displayed in Step S505 and represent the sheets stacked on the respective sheet discharge trays. That is, each of the sheet bundle images 1501 to 1505 corresponding to the processed job is mapped to a position of the sheet discharge tray corresponding thereto. A sheet bundle 1510 is a sheet bundle corresponding to the image forming job designated in the list region 1110. In this case, it is shown that a job (job name: image forming job #3) having a job ID of "00000003" is designated, and the sheet bundle corresponding to the designated job is the sheet bundle image 1510. The job ID and the sheet bundle image 1510 are displayed in an emphasized manner with a color different from those of other job IDs and sheet bundle images 1501 to 1505. In this manner, the position of the sheet bundle (sheet bundle image 1510 in the example of FIG. 15) corresponding to the designated processed job can be easily recognized. Alternatively, only the sheet bundle image 1510 corresponding to the designated processed job may be mapped in the system configuration image.

As described above, according to the first embodiment, the position of the sheet bundle corresponding to a predetermined image forming job can be easily identified. Therefore, the sheet bundle corresponding to the processed job can be reliably collected. Further, the sheet stacking states at all discharge destinations can be easily recognized. In this manner, it can be determined which sheet discharge destination is required to be designated for the image forming jobs for which images are formed thereafter to achieve efficiency, and the convenience is enhanced. In particular, when small-lot high-variety image formation is performed, it has been difficult to identify a position of a sheet bundle corresponding to a predetermined image forming job from a large amount of stacked sheets discharged to a plurality of locations in a divided manner, but the identification is facilitated according to the first embodiment.

Other Embodiment

In the first embodiment, a configuration example in which the information processing apparatus 100 and the image forming apparatus 101 are separate members is described, but the image forming apparatus 101 may have the function of the information processing apparatus 100. That is, the image forming apparatus 101 may include the storage 112, the display 113, and the input portion 114. In this case, the functions of generating the system configuration image and the sheet bundle image are achieved by the controller 121. That is, the controller 121 generates the system configuration image and the sheet bundle image, and combines the generated system configuration image and the generated sheet bundle image to display the result on the display 113. Further, the controller 121 operates as control device for updating the display of the sheet bundle image every time the detection result is received from the sheet presence/absence detection sensor 330 or the like.

Further, in the first embodiment, description is given of an example in which the sheet discharge state information 133 is transmitted to the information processing apparatus 100 every time one sheet bundle image is formed, but this is merely an example. For example, the sheet discharge state information 133 may be transmitted each time a predetermined time period elapses. Further, in the first embodiment, description is given of an example in which the entire sheet discharge state information is transmitted to the information processing apparatus 100, but only the difference from the previously-transmitted sheet discharge state information may be transmitted. Further, in the first embodiment, description is given of an example in which one image forming job is designated in the processed-job list, but a plurality of processed jobs may be simultaneously designated. In this case, the color of the corresponding sheet bundle image may be a color corresponding to each of the processed jobs. Further, in the first embodiment, the coefficient P is used to calculate the height of the sheet bundle, but the value of the coefficient P may also be changed in accordance with the information on the thickness of the sheet so that the height of the sheet bundle is also changed in accordance therewith.

Specifically, a coefficient P that varies depending on the basis weight or the sheet type identified from the sheet ID may be stored in the storage 122, and the height of the sheet bundle and the rendering start height may be calculated by the following calculation method in the above-mentioned processing of Steps S504, S509, and S510. Step S504: (height of sheet bundle of tray N)=(sheet number count of sheet bundle information #1)×(coefficient P1 corresponding to sheet ID of sheet bundle information #1)+(sheet number count of sheet bundle information #2)×(coefficient P2 corresponding to sheet ID of sheet bundle information #2)+ . . . +(sheet number count of sheet bundle information #(N−1))×(coefficient P(N−1) corresponding to sheet ID of sheet bundle information #(N−1))+(sheet number count of sheet bundle information #N)×(coefficient P(N) corresponding to sheet ID of sheet bundle information #N). Step S509: (rendering start height offset of sheet bundle (M))=(sheet number count of sheet bundle information #1)×(coefficient P1 corresponding to sheet ID of sheet bundle information #1)+(sheet number count of sheet bundle information #2)×(coefficient P2 corresponding to sheet ID of sheet bundle information #2)+ . . . +(sheet number count of sheet bundle information #(N−1))×(coefficient P(N−1) corresponding to sheet ID of sheet bundle information #(N−1)). Step S510: (height of sheet bundle (M))=(sheet number count of sheet bundle information #M)×(coefficient P(M) corresponding to sheet ID of sheet bundle information #M).

As described above, according to the embodiments, the sheet stacking state is displayed with the sheet bundle image, and hence the sheet stacking state of the sheets before collection can be easily recognized.

The operations described with reference to FIGS. 4A-4G etc., can be achieved by, for example, an application specific integrated circuit (ASIC) or a system-on-a-chip (SoC).

While the present disclosure has been described with reference to embodiments, it is to be understood that the disclosure is not limited to the disclosed embodiments. The scope of the following claims is to be accorded the broadest interpretation to encompass all such modifications and equivalent structures and functions.

This application claims the benefit of Japanese Patent Application No. 2017-101133, filed May 22, 2017 and Japanese Patent Application No. 2018-011270, filed Jan. 26, 2018 which are hereby incorporated by reference herein in their entirety.

What is claimed is:

1. An image forming system comprising:

an image forming apparatus configured to form an image on a sheet based on an image forming job;

a plurality of sheet discharge apparatuses, wherein each sheet discharge apparatus is configured to receive a sheet from the image forming apparatus and discharge the sheet to a sheet discharge tray; and an information processing apparatus having a control unit to control the image forming apparatus, and having at least one processor and at least one memory coupled to each other and to perform operations including:

obtaining 1) identification information of the plurality of sheet discharge apparatuses which is connected to the image forming apparatus and 2) an arrangement order of each sheet discharge apparatus from the image forming apparatus to generate a system configuration image for visually displaying an arrangement mode of the image forming apparatus and the plurality of sheet discharge apparatuses configuration of the image forming system, obtaining, from the image forming apparatus when the image forming job is executed, 3) discharge information of the sheet discharge tray to which the sheet related to the image forming job is discharged and 4) stacking information representing a sheet stacking amount of those sheets discharged, as to the image forming job, to the sheet discharge tray to generate a sheet bundle image for visually displaying the sheets stacked on the sheet discharge tray, displaying a sheet discharge status screen having an execution history of the image forming job displayed with the sheet bundle image, wherein the sheet bundle image is displayed in the system configuration image as combined at a position of the sheet discharge tray to which the sheet of the image forming job is discharged, changing, upon receiving a selection of a particular image forming job in the execution history, a display color of the sheet bundle image which corresponds to the selected particular image forming job to a display color which differs from a display color of a sheet bundle image corresponding to a second image forming job other than the selected particular image forming job, and updating, when the second image forming job is executed while the sheet discharge status screen is being displayed, the sheet discharge status screen being displayed to a second sheet discharge status screen in which a sheet bundle image generated for the second image forming job is combined at a position of the sheet discharge tray in the system configuration image.

2. The image forming system according to claim 1, wherein each of the plurality of sheet discharge apparatuses includes two or more sheet discharge trays.

3. The image forming system according to claim 1, wherein the control unit communicates with the image forming apparatus via a network.

4. The image forming system according to claim 1, wherein, when the sheet is removed from the sheet discharge tray whose sheet discharge status screen is being displayed, the sheet discharge status screen being displayed is updated to a third sheet discharge status screen in which the sheet bundle image corresponding to the sheet discharged to the sheet discharge tray is eliminated.

5. An information processing apparatus comprising:

a control unit to control an image forming apparatus configured to form an image on a sheet based on an image forming job, wherein the information processing apparatus is configured to communicate with a plurality of sheet discharge apparatuses, and each sheet discharge apparatus is configured to receive a sheet from the image forming apparatus and discharge the sheet to a sheet discharge tray; and at least one processor and at least one memory coupled to each other and to perform operations including:

obtaining 1) identification information of the plurality of sheet discharge apparatuses which is connected to the image forming apparatus and 2) an arrangement order of each sheet discharge apparatus from the image forming apparatus to generate a system configuration image for visually displaying an arrangement mode of the image forming apparatus and the plurality of sheet discharge apparatuses configuration of the image forming system, obtaining, from the image forming apparatus when the image forming job is executed, 3) discharge information of the sheet discharge tray to which the sheet related to the image forming job is discharged and 4) stacking information representing a sheet stacking amount of those sheets discharged, as to the image forming job, to the sheet discharge tray to generate a sheet bundle image for visually displaying the sheets stacked on the sheet discharge tray, displaying a sheet discharge status screen having an execution history of the image forming job displayed with the sheet bundle image, wherein the sheet bundle image is displayed in the system configuration image as combined at a position of the sheet discharge tray to which the sheet of the image forming job is discharged, changing, upon receiving a selection of a particular image forming job in the execution history, a display color of the sheet bundle image which corresponds to the selected particular image forming job to a display color which differs from a display color of a sheet bundle image corresponding to a second image forming job other than the selected particular image forming job, and updating, when the second image forming job is executed while the sheet discharge status screen is being displayed, the sheet discharge status screen being displayed to a second sheet discharge status screen in which a sheet bundle image generated for the second image forming job is combined at a position of the sheet discharge tray in the system configuration image.

* * * * *